US006409406B1

(12) United States Patent
Schwartzman

(10) Patent No.: US 6,409,406 B1
(45) Date of Patent: Jun. 25, 2002

(54) VALVED FLUID APPLICATOR

(76) Inventor: Gilbert Schwartzman, 1025 Old White Plains Rd., Mamaroneck, NY (US) 10543

( * ) Notice: Subject to any disclaimer, the term of this patent is extended or adjusted under 35 U.S.C. 154(b) by 0 days.

(21) Appl. No.: 09/938,639

(22) Filed: Aug. 27, 2001

(51) Int. Cl.[7] ..... B43M 11/06

(52) U.S. Cl. ..... 401/186; 401/183; 401/266; 401/265; 222/209; 222/213

(58) Field of Search ..... 401/263, 265, 401/266, 186, 183, 184, 185; 222/209, 212, 213

(56) References Cited

U.S. PATENT DOCUMENTS

| | | | | |
|---|---|---|---|---|
| 936,186 A | * | 10/1909 | Tellerson | 222/213 |
| 950,483 A | | 3/1910 | Howe | |
| 1,014,465 A | * | 1/1912 | Hall | 401/186 |
| 1,425,242 A | | 8/1922 | Dinardo | |
| 1,505,442 A | | 8/1924 | Stephens | |
| 1,540,838 A | | 6/1925 | Hensley | |
| 2,024,413 A | | 12/1935 | Witt | |
| 2,974,350 A | | 3/1961 | Schwartzman | |
| 3,035,299 A | | 5/1962 | Gordon et al. | |
| 3,087,656 A | * | 4/1963 | Dougherty | 222/213 |
| 3,107,035 A | * | 10/1963 | Cholet | 222/213 |
| 3,264,676 A | | 8/1966 | Schwartzman | |
| 4,960,340 A | | 10/1990 | Tamiya et al. | |
| 5,172,996 A | | 12/1992 | Tamiya et al. | |
| 5,248,212 A | | 9/1993 | Lhuisset | |

FOREIGN PATENT DOCUMENTS

| | | | | |
|---|---|---|---|---|
| SD | 1818257 A1 | * | 5/1993 | 401/186 |

* cited by examiner

*Primary Examiner*—David J. Walczak
(74) *Attorney, Agent, or Firm*—Clyde I. Coughenour

(57) ABSTRACT

An applicator is provided with a flexible container, a discharge passage, a valve seat, and internal springs having first ends attached to one end of a rod that has a valve on its other end. The second ends of the leaf spring are secured to the container. The springs are in an arcuate configuration so as to press the valve into a closed position. Pressure on the flexible container presses on the arcuate shaped springs, straightening them to some degree. Due to the longitudinal increase in the length of the springs, the valve is lifted off of its seat, opening a passage for fluid flow from the container interior through the discharge passage of the applicator nib or pad.

20 Claims, 2 Drawing Sheets

VALVED FLUID APPLICATOR

BACKGROUND OF THE INVENTION

1. Field of the Invention

A fluid applicator has a flexible fluid container enclosing resilient spring forming spider legs attached to a rod, one end of which acts as a valve. Pressure on the flexible container presses on the resilient spring legs to lift the valve off of its seat.

2. Description of Related Art

It is common in the art to have containers with internal spring-loaded, valved rods. C. W. Howe (U.S. Pat. No. 950,483, issued Mar. 1, 1910) and P. A. Dinardo (U.S. Pat. No. 1,425,242, issued Aug. 8, 1922) and T. J. Stephens (U.S. Pat. No. 1,505,442, issued Aug. 19, 1924) and J. R. Hensley (U.S. Pat. No. 1,540,838, issued Jun. 9, 1925) and W. J. J. Gordon et al (U.S. Pat. No. 3,035,299, issued May 22, 1962) are examples of such devices where pressing on the spring causes the valve to be lifted off of its seat.

Tamiya et al (U.S. Pat. No. 4,960,340, issued Oct. 2, 1990 and U.S. Pat. No. 5,172,996, issued Dec. 22, 1992) and F. Lhuisset (U.S. Pat. No, 5,248,212, issued Sep. 28, 1993) are examples of an internal spring-loaded valves lifted off of their seat by pressure exerted against flexible container sides.

SUMMARY OF THE INVENTION

The present invention simplifies and improves over the dispensers of the prior art. A fluid dispensing applicator has a resilient container body that is provided with an internally positioned spring biased valve. The spring is preferably in the shape of bent or curved leaf springs biased so as to close a valve that controls fluid flow from the container. The spring is held within the container in a central or upper location. Pressure on an intermediate portion of the container creates a pressure on the springs that causes the springs to extend or flatten out within the container. By flattening out, the springs move a lower or distal end of a valve rod away from the discharge upper or proximal end of the container. This moves an upper or proximal valve end of the rod away from a valve seat in the upper or proximal end of the container permitting fluid flow from the container.

DESCRIPTION OF THE PREFERRED EMBODIMENTS

Figure 2:
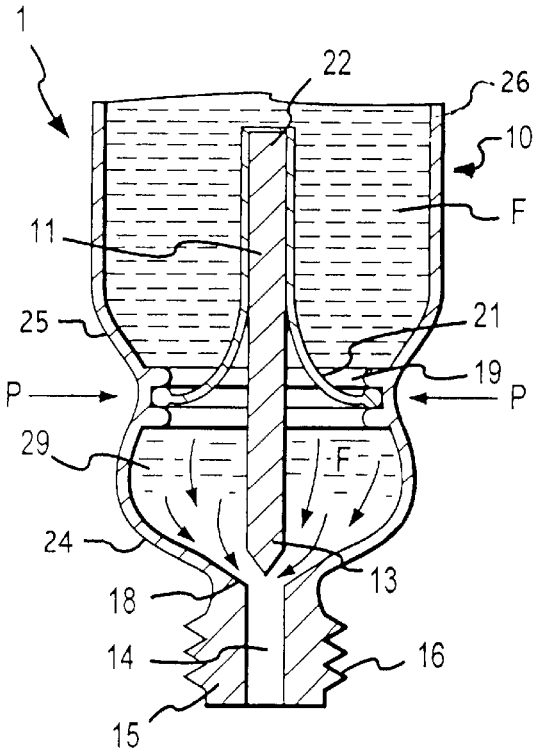
FIG. 2 is a cross-sectional view of the applicator of FIG. 1 in its fluid dispensing position.
Figure 3:
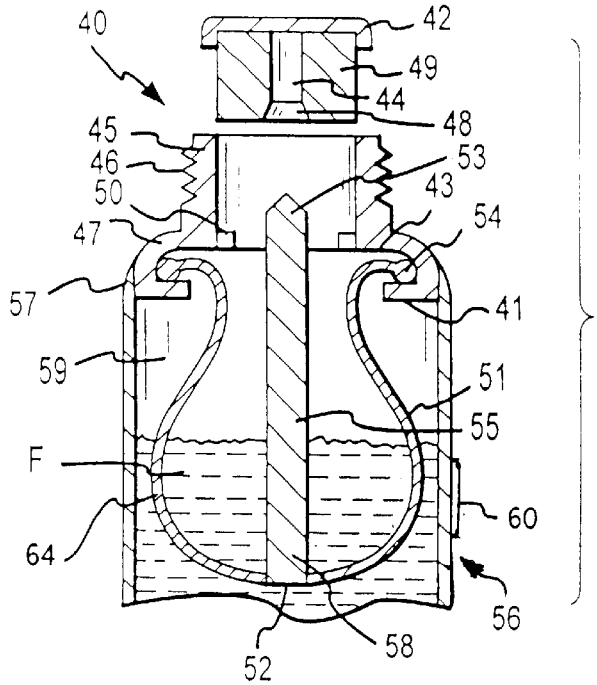
FIG. 3 is a partially exploded cross-sectional view of a second embodiment of the invention in its at rest position.
Figure 4:
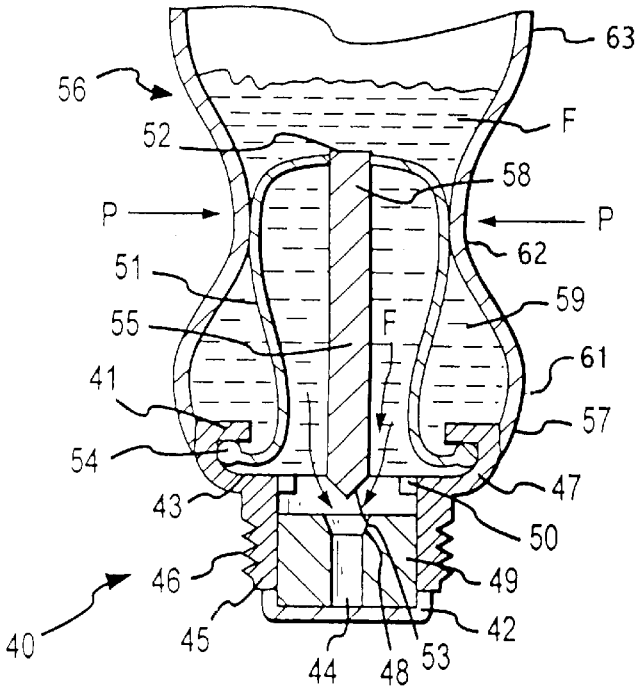
FIG. 4 is a cross-sectional view of the applicator of FIG. 3 in its fluid-dispensing position.

The applicator of the present invention is shown in FIGS. I through 4. A curved leaf-type spring is preferred. The embodiment of FIGS. 1 and 2 shows a concave spring with respect to the applicator container, while FIGS. 3 and 4 show a convex spring with respect to the applicator container.

Figure 1:
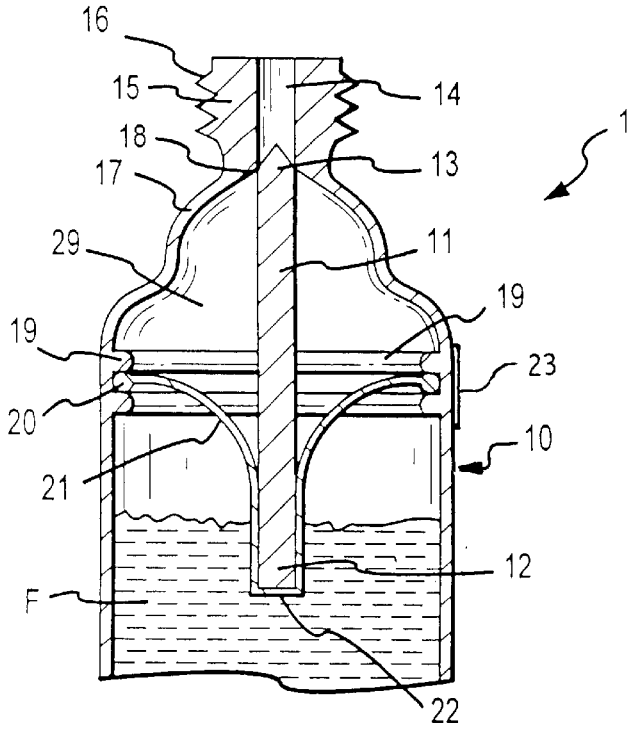
FIG. 1 is a cross-sectional view of an applicator of the invention in its at-rest position.

In FIG. 1 the applicator 1 is shown with fluid F in a resilient container 10 having an upper 24, middle 25 and lower 26 section with upper or proximal valved portion or end 15 with threads 16 used to attach an application nib, pad or brush. A fluid passage 14 in the valved end of the container communicates with the container interior 29 through a neck portion 17. A valve seat 18 is positioned between the fluid passage 14 and the container interior 29. At an intermediate location, a positioning means is provided. This positioning means is shown as integral ridges 19 on the interior of the container but could be a sleeve or other integral or separate positioning means. The container 10 is translucent or transparent to reveal the spring 21 and/or positioning means 19 and/or spring attachment ring 20, to identify the place where valve opening pressure is to be applied. Alternatively, the container can be marked or provided with indicia 23 to identify the area pressure is to be applied to open the valve.

A valve shaft or rod 11 is shown within the container interior 29. The valve rod 11 is provided at one proximal upper end with a valve 13 that can seat against the valve seat 18 of the container upper or proximal end 15. The rod is provided at a second distal or lower end 12 with a surface or other means for attachment 22 to a spring means 21.

The positioning or retaining means 19 hold the proximal upper ends or upper extent of the springs or spring attachment strap or ring 20, at the outer extremes within the resilient container 10. The spring means includes the spring attachment ring 20, when used, and a plurality of resilient leaf springs or spider legs 21 that extend within the container 10 interior 29. The resilient springs are essentially concavely bent leaf springs, with respect to the container walls, that may be independently positioned between the retaining means or ridges 19, but preferably are attached to a resilient attachment ring 20 positioned between the ridges 19. The configuration of the spring legs is not critical as long as pressure on the sides of the applicator causes a longitudinal extension of the legs within the container 10. The leaf springs 21 of FIGS. 1 and 2 are shown in a concave configuration with respect to the flexible container 10.

The springs or spider legs 21 come together at the distal or lower end 12 of the rod 11 and are attached 22 to the rod at that point. The spider legs are resilient but not elastic, thus maintaining an essentially constant length. With the legs biased in an arcuate configuration, as shown in FIG. 1, they function similar to a leaf spring, pressing the shaft or rod 11 proximate or upper valve end 13 against the container 10 upper or proximate end 15 valve seat 18. By applying pressure P against the resilient container 10, the container is collapsed in the area of the retaining ridges 19, effectively reducing the diameter of the container in that area. To compensate for the reduction in diameter, the spring legs 21 confined by the retaining ridges 19, are forced to straighten out somewhat. The straightening of the resilient springs causes the lower or distal attached end 22 of the rod 11 to move away from the valve seat 18, opening a passage to the container fluid passage 14 and allowing a flow of the fluid F from the container interior 29 when the container is inverted. Removing pressure P from the flexible container 10, returns the resilient container to its original shape due to the container's own resilience and the resilience of the leaf springs or spider legs 21. The return to original shape closes off the passage to fluid flow.

FIGS. 3 and 4 show a second embodiment of the applicator. Essentially the same basic concept is involved as in FIGS. 1 and 2 except for the substitution of convex leaf springs 51 for the concave leaf springs 21.

The applicator 40 of FIGS. 3 and 4 has a flexible container 56 with a closure 47 secured 57 to the container 56, having upper 61, middle 62 and lower 63 section with upper or proximal end forming the fluid containing enclosure. The closure 47 accommodates a plug 49 that supports a coating means 42.

While the plug 49 is shown supporting a pad 42, any type writing or coating implement can be supported by the plug. The plug fits within an upper recess within the closure 47. A passage 44 extends through the plug for conducting fluid F through the plug from an inner end forming a valve seat 48 to an outer end accessing the coating means 42.

The closure 47 outer or proximal end 45 is provided with threads 46 along an outer surface for securing a cap over the coating means 42 and has an opening or recess along its inner surface for receiving the plug 49. The lower or inner extent of the opening along the inner surface of the closure 47 can be provided with a stop 50 to position and/or prevent the plug from entering the container 56. The lower or inner extent of the closure 47 widens out for attachment 57 to the flexible container 56 around its outer surface. The two can be secured together by heat, adhesive means, etc. A flange 41 extends inwardly along the closure 47 lowermost inner surface forming a pocket for securing one end of the leaf springs 51 or a leaf spring retaining ring 54. The retaining ring can be an incomplete rigid or an incomplete or complete resilient ring.

The valve means is made up primarily of a rod 55 and leaf springs 51. The upper end of the rod 53 forms a valve and the lower end of the rod 58 is attached 52 to the lowermost extent of the leaf springs 51. The upper extent or upper ends of the leaf springs, or their retaining ring 54, is secured from longitudinal movement in the flexible container, by placement within the pocket formed by the flange 41. The convex springs extend outwardly and upwardly from their point of connection 52 with the rod 55 lower or inner end 58. The leaf springs 51 extend outwardly to contact or almost contact the walls of the flexible container 56 at their outer extremes 64. while pressing the valve end 53 of the rod 55 upwardly into contact with the valve seat 48 of the plug 49 positioned within the closure 47.

The container 56 can be transparent or translucent and the leaf springs 51 can be conspicuously colored to indicate the area pressure must be applied to open the valve for fluid passage. Alternatively, the flexible container can be colored, printed or otherwise marked 60 to identify the location pressure must be applied for valve opening and fluid discharge.

The valve is opened by pressing P on the flexible container 56 and the leaf springs 51 along the outer extent or extreme 64 of the leaf springs within the container. Pressure on the leaf springs causes a longitudinal extension in the spring length within the container. The longitudinal distance between the upper spring ends 54 and the rod base 58 at 52 is increased. Because the upper spring ends 54 are secured in place and the lower ends 52 are free to move longitudinally within the container 56, the rod 55 is moved inwardly causing the rod valve end 53 to move away from the valve seat 48 opening a passage between the container enclosure 59 and the applicator pad 42 through passage 44 for fluid F flow.

It is believed that the construction, operation and advantages of this invention will be apparent to those skilled in the art. It is to be understood that the present disclosure is illustrative only and that changes, variations, substitutions, modifications and equivalents will be readily apparent to one skilled in the art and that such may be made without departing from the spirit of the invention as defined by the following claims.

What is claimed is:

1. A fluid applicator comprising:

a flexible container having walls that form upper, lower and middle sections;

a discharge opening at an upper portion of said applicator adjacent to said upper section of said flexible container;

a fluid passage to said discharge opening;

a valve seat in said upper portion at an inner end of said fluid passage;

a valve means for contacting said valve seat to block said fluid passage;

said valve means including a rod having an upper end and a lower end;

said rod upper end having a valve and said rod lower end having resilient springs attached thereto;

said resilient springs having a lower end and an upper end;

said resilient springs lower end being attached to said rod lower end;

said resilient springs extending upwardly from said rod lower end with said springs upper ends connected to said flexible container upper section to resiliently hold said valve against said valve seat.

2. A fluid applicator as in claim 1 wherein:

said fluid passage inner end is tapered outwardly and downwardly to form said valve seat;

said rod upper end is tapered downwardly and outwardly to form said valve.

3. A fluid applicator as in claim 1 wherein:

said flexible container upper section is provided with means for positioning and constraining said resilient springs upper ends.

4. A fluid applicator as in claim 3 wherein:

said resilient springs are in the shape of leaf springs.

5. A fluid applicator as in claim 4 wherein:

said leaf springs are in a concave configuration with respect to said container walls.

6. A fluid applicator as in claim 3 wherein:

said resilient springs open upwardly in an arcuate shape for pressing said valve against said valve seat;

said resilient springs have outer extremes that extend adjacent to said walls of said flexible container;

said flexible container is see-through so that said resilient springs outer extremes can be observed.

7. A fluid applicator as in claim 3 wherein:

said flexible container is provided with indicia to identify the location where pressure can be applied to open said valve means;

pressure on said indicia at the location identified presses perpendicularly on said springs to open said valve.

8. A fluid applicator as in claim 3 wherein:

said resilient springs having outer ends at said resilient springs upper ends;

said resilient springs are shaped and positioned and said resilient springs outer ends are secured so that pressure on and distortion of said flexible container middle section extends said resilient springs longitudinally to lift said valve off of said valve seat to open access to said fluid passage.

9. A fluid applicator as in claim 3 wherein:

said resilient springs form a convex configuration with respect to said container walls that form said container middle section.

10. A fluid applicator as in claim 9 wherein:

said resilient springs are in the shape of leaf springs;

said resilient springs, from said rod lower end to essentially said means for positioning and constraining said resilient springs upper ends, form a convex configuration with respect to said flexible container walls.

11. A fluid applicator as in claim 1 wherein:

said resilient springs open upwardly in an arcuate shape that presses said valve against said valve seat.

12. A fluid applicator as in claim 1 wherein:

said resilient springs form a concave configuration with respect to said container walls that form said container middle section.

13. A fluid applicator as in claim 1 wherein:

said resilient springs are in the shape of leaf springs;

said resilient springs lower ends abut and extend along said rod lower end for a distance.

14. A fluid applicator as in claim 1 wherein:

said resilient springs are leaf springs;

said resilient springs upper end is secured to said flexible container by ridges on said flexible container.

15. A fluid applicator as in claim 1 wherein:

said resilient springs are leaf springs;

said resilient springs upper ends are secured adjacent to said flexible container upper section by a retainer flange.

16. A fluid applicator as in claim 15 wherein:

said resilient springs lower ends extend radially outwardly from said rod lower end before extending upwardly;

said leaf springs are in a convex configuration with respect to said flexible container walls.

17. A fluid applicator as in claim 1 wherein:

said container upper section is provided with a container closure;

said container closure is secured to said flexible container upper section;

a retainer flange on said container closure lower extent secures said resilient springs upper ends in place.

18. A fluid applicator as in claim 17 wherein:

said discharge opening and valve seat are in a plug held within said container closure.

19. A fluid applicator as in claim 18 wherein:

said resilient springs are leaf springs in a convex configuration with respect to said flexible container walls;

said leaf springs upper ends are secured within a pocket formed by said retainer flange of said container closure.

20. A fluid applicator as in claim 19 wherein:

said container is provided with a means for informing a user where pressure is to be applied to said container to open said valve for fluid passage.

* * * * *